US006534118B1

(12) United States Patent
Nakamura et al.

(10) Patent No.: US 6,534,118 B1
(45) Date of Patent: Mar. 18, 2003

(54) METHOD OF APPLYING A SHIELDING FILM TO A LIGHT SOURCE BULB

(75) Inventors: Koichi Nakamura, Shizuoka (JP); Toshiaki Mitobe, Shizuoka (JP); Kunimasa Mochizuki, Shizuoka (JP); Makoto Michino, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 127 days.

(21) Appl. No.: 09/635,008

(22) Filed: Aug. 8, 2000

(30) Foreign Application Priority Data

Aug. 9, 1999 (JP) ..... 11-225109

(51) Int. Cl.[7] ..... B05D 5/06; H01J 61/40

(52) U.S. Cl. ..... 427/106; 427/8; 427/10; 427/110; 427/168; 427/240; 427/313; 427/117

(58) Field of Search ..... 427/8, 10, 106, 427/110, 168, 240, 425; 313/110, 117

(56) References Cited

U.S. PATENT DOCUMENTS 4,076,489 A * 2/1978 Schroeter et al. ..... 427/106
4,197,333 A * 4/1980 Leach et al. ..... 427/106
4,656,048 A * 4/1987 Kudoh et al. ..... 427/102
4,920,422 A * 4/1990 Lapierre ..... 346/2
5,489,623 A * 2/1996 Babb et al. ..... 427/508
5,646,471 A * 7/1997 Scholler et al. ..... 313/112
5,671,995 A 9/1997 Serizawa et al. ..... 362/61

* cited by examiner

*Primary Examiner*—Shrive P. Beck
*Assistant Examiner*—Michael Cleveland
(74) *Attorney, Agent, or Firm*—Sughrue Mion, PLLC

(57) ABSTRACT

A method for producing a light source bulb wherein a shielding film is formed on the outer peripheral face of a glass tube extending along a reference bulb axis, such that a coating for providing the shieiding film can be applied efficiently and precisely onto the outer peripheral face of the glass tube even though the shielding film is complicated in configuration. The method includes horizontally placing a light source bulb, vertically placing a coating discharging portion, moving a front edge face of the coating discharging portion close to the outer peripheral face of the shroud tube, and applying the coating by moving the coating discharging portion and the light source bulb relative to each other along a reference bulb axis and rotating the light source bulb upon the reference bulb axis while the coating is being discharged from the coating discharging portion.

8 Claims, 6 Drawing Sheets

116
116A
116B
116a
L
P
118

METHOD OF APPLYING A SHIELDING FILM TO A LIGHT SOURCE BULB

BACKGROUND OF THE INVENTION

1. Field of the Invention

The present invention relates to a method for producing light source bulbs such as vehicular headlamps and more particularly to a process for coating the outer peripheral face of the glass tube of a light source bulb with a shielding film.

2. Description of the Related Art

Light source bulbs of vehicular headlamps are generally equipped with glass tubes and some of the glass tubes such as low-beam discharge bulbs are known to have shielding films formed on the outer peripheral faces of the glass tubes.

The shielding film is formed by applying a coating to the outer peripheral face of such a glass tube. As shown in FIGS. 7A and B, the coating application has heretofore been carried out by moving a coating application jig 204 supplied with a coating P' longitudinally along the outer peripheral face of a glass tube 4 in such a state that a light source bulb 2 has been fixed to a bulb fixing jig 202.

A single coating application jig is used to apply a coating of a given width in the conventional coating application method. However, when the shielding film is complicated in configuration, a plurality of coating application jigs have to be prepared requiring the exchange one jig for another. Therefore, coating application efficiency is poor and, moreover, it is difficult to precisely apply a coating to an estimated position.

SUMMARY OF THE INVENTION

An object of the present invention is to provide a method for producing a light source bulb wherein a coating for providing a shielding film can be applied efficiently and precisely onto the outer peripheral face of a glass tube even though the shielding film is complicated in configuration.

The invention is intended to accomplish the object above by providing an improved coating application method.

In a method for producing a light source bulb having a cylindrical glass tube extending along a reference bulb axis with a predetermined shielding film formed on the outer peripheral face of the glass tube, a process for applying a coating for providing the shielding film onto the outer peripheral face of the glass tube comprises the following steps:

horizontally placing the light source bulb, vertically placing a coating discharging portion with the bottom up and moving the front edge face of the coating discharging portion close to the outer peripheral face of the glass tube; and applying the coating thereto by moving the coating discharging portion and the light source bulb relatively to each other along the reference bulb axis and rotating the light source bulb upon the reference bulb axis while the coating is being discharged from the coating discharging portion.

The "reference bulb axis" means a reference optical axis of a light source bulb.

The "light source bulb" is not limited to any specific kind of light source bulb but includes discharge bulbs and halogen bulbs, for example, as long as they have shielding films formed on the outer peripheral faces of their glass tubes. With respect to uses, though the "light source bulb" is intended typically for use as a light source bulb of a vehicular headlamp, it may be intended for any other use. Moreover, the configuration of the "shielding film" is not limited to any specific one.

The "coating" is also not limited to any specific kind of coating but includes coatings whose composition, color, viscosity and so on vary as long as they function as shielding films formed by coating application.

"Horizontally placing the light source bulb" means that the light source bulb is disposed in such a posture that its reference bulb axis extends horizontally.

As set forth above, in order to apply the coating for providing the shielding film onto the outer peripheral face of the glass tube in the method of producing the light source bulb according to the invention, the light source bulb is horizontally placed and the front edge face of a coating discharging portion vertically placed with the bottom up is moved close to the outer peripheral face of the glass tube. Further, the coating discharging portion and the light source bulb are moved relative to each other along the reference bulb axis, and the light source bulb is rotated upon the reference bulb axis while the coating is being discharged from the coating discharging portion. Consequently, the following advantage is achievable.

As the behavior of the light source bulb at the time of the coating application is represented by the rotation of the light source bulb about the reference bulb axis or a combination of rotation of the light source bulb and the movement thereof along the reference bulb axis, the light source bulb is kept horizontal at all times. On the other hand, as the behavior of the coating discharging portion at the time of coating application is equivalent to standing still or its movement along the reference bulb axis, the coating discharging portion is kept vertical with the bottom up at all times. Accordingly, the coating can be held between the front edge face of the coating discharging portion and the outer peripheral face of the glass tube in a well-balanced condition after the front edge face of the coating discharging portion is moved close to the upper end portion of the outer peripheral face of the glass tube. Thus, the coating can be applied precisely to the outer peripheral face of the glass tube by moving the coating discharging portion and the light source bulb relatively to each other in that condition.

Even in a case where the shielding film is complicated in configuration, the shielding film can be formed by applying the coating once while properly combining the movement of the coating discharging portion and the light source bulb relative to each other along the reference bulb axis with the rotation of the light source bulb about the reference bulb axis.

Although setting the diameter of the front end hole of the coating discharging portion at a small value results in increasing the distance of the movement of the coating discharging portion and the light source bulb relative to each other because the width of the coating applied becomes narrow, precise coating application can be carried out even though the shielding film is complicated in configuration. When the shielding film is not as complicated in configuration, on the other hand, the diameter of the front end hole of the coating discharging portion is set at a large value to increase the width of the coating. Accordingly, the distance of the movement of the coating discharging portion and the light source bulb relative to each other can be shortened, whereby coating application efficiency is increased.

Even though the shielding film may be complicated in configuration, the coating for providing the shielding film can thus be applied precisely to the outer peripheral face of the glass tube, according to the invention.

In order to apply the coating precisely, the width of the coating is required to be maintained as uniformly as possible and in this sense the gap between the front edge face of the coating discharging portion and the outer peripheral face of the glass tube is also required to be kept substantially constant as all times. On the other hand, the glass tube, as an object to be coated with the shielding film, is a cylindrical glass tube extending along the reference bulb axis and there are a few cases where the center axis of the cylinder does not coincide with the reference bulb axis. Even in a case where the center axis of the cylinder does not coincide with the reference bulb axis, it is common for the center axes of the cylinders of actually manufactured glass tubes to be slightly deviated from the respective reference bulb axes.

Therefore, the coating discharging portion or the light source bulb is preferably slightly displaced in the vertical direction so that the gap between the front edge face of the coating discharging portion and the outer peripheral face of the glass tube may be kept substantially constant. Even in a case where the slight displacement control is to be performed like this, the coating discharged from the coating discharging portion can be held in a well-balanced condition between the front edge face of the coating discharging portion and the outer peripheral face of the glass tube.

In order to effect the slight displacement control accurately, importance is attached to securing accurate knowledge as to how the vertical position of a region opposite to the coating discharging portion on the outer peripheral face of the shroud tube varies as the coating discharging portion and the light source bulb move relatively to each other.

Therefore, measuring an eccentricity degree of the circular section of the glass tube with respect to the reference bulb axis at two or more spots along the reference bulb axis and computing three-dimensional position data on the estimated position where the coating is applied onto the outer peripheral face of the glass tube according to the measured data make it possible to secure accurate knowledge as to how the vertical position of the region opposite to the coating discharging portion varies as the coating discharging portion and the light source bulb move relatively to each other. In other words, the slight displacement control can be effected accurately.

With the arrangement above, a coating having a viscosity of 0.1–2 Pa·s (Pascal·sec) is preferred, though the viscosity of the coating is not limited to any specific value as stated above. The reason for this is that the coating applied to the outer peripheral face of the glass tube tends to sag at a viscosity of less than 0.1 Pa·s, whereas when the viscosity exceeds 2 Pa·s, the coating dischargeability from the coating discharging portion tends to become poor, which results in reducing the coating application efficiency.

The coating for providing the shielding film is usually composed of coating liquid containing a filler, and the coating discharging portion tends to become clogged with the coating because the filler quickly settles out; consequently, the coating liquid needs stirring to prevent this impediment. However, the coating discharging portion will become complicated in structure and also costly in a case where the coating discharging portion is provided with a stirring mechanism.

Therefore, the coating discharging portion is formed with a syringe and a predetermined amount of coating stirred in a vessel other than the syringe is sucked by and discharged from the syringe, whereby the coating discharging portion is prevented from being clogged with the coating without complicating the structure of the coating discharging portion and making any costly arrangement. The "predetermined amount" means an amount to be appropriated for applying the coating once or a suitable amount exceeding the amount necessary therefor.

DETAILED DESCRIPTION OF THE PREFERRED EMBODIMENT

Figure 1:
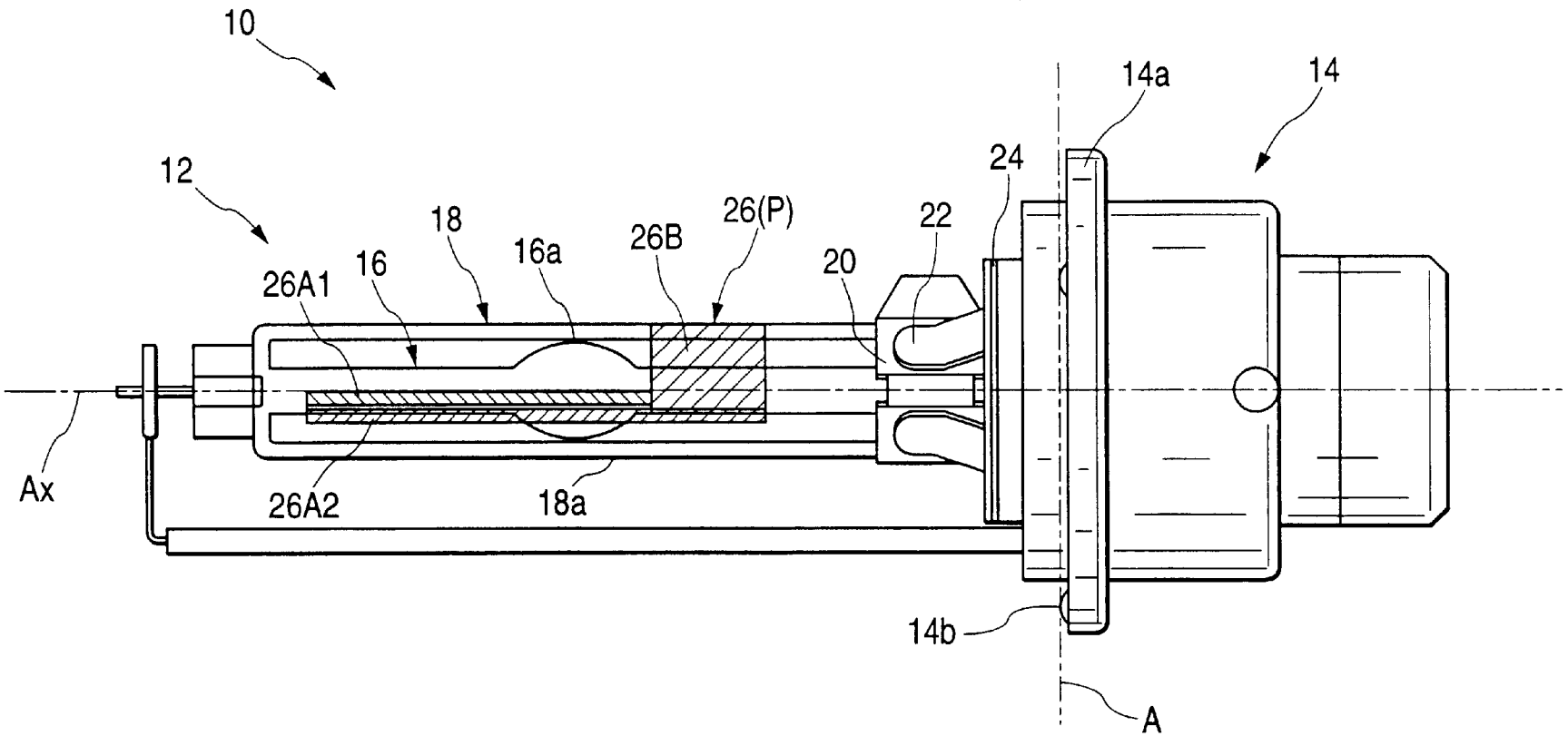
FIG. 1 is a side view of a light source bulb as an object to be produced through a method embodying the invention.

An embodiment of the present invention will now be described with reference to the drawings.

The light source bulb 10 is a low-beam discharge bulb mounted in a vehicular headlamp and comprises an arc tube unit 12 extending around and along a reference bulb axis Ax extending in the longitudinal direction, and an insulating plug 14 for fixedly supporting the rear end portion of the arc tube unit 12.

The arc tube unit 12 is constituted of an arc tube 16 and a cylindrical shroud tube 18 (glass tube) surrounding the arc tube 16, these being integrally formed.

The arc tube 16 is formed by embedding a longitudinal pair of electrode assemblies (not shown) in a quartz arc tube body. A substantially elliptic spherical light emitting tube portion 16*a* is formed in the substantially central position of the cross direction. The shroud tube 18 is also made of quartz and both its front and rear end portions are welded to the arc tube 16.

A positioning protrusion 14*b* is circumferentially formed in three places at the front of the ring portion 14*a* of the insulating plug 14. A plane A passing the front ends of these positioning protrusions 14*b* is so arranged as to form a reference bulb plane that is perpendicular to the reference bulb axis Ax.

In order that a discharge light emitting portion (not shown) formed within the light emitting tube portion 16*a* of the arc tube 16 may be positioned accurately with respect to the reference bulb axis Ax, the arc tube unit 12 is fixedly supported by the insulating plug 14 as shown below.

A metal band 20 is fixed to the rear end portion of the outer peripheral face 18*a* of the shroud tube 18. Slider metal parts 22 are fixedly coupled by laser welding to the metal band 20 in such a way that while the metal band 20 is mated with the slider metal parts 22, the slider metal parts 22 are coupled to the metal band 20 after the primary aligning of the arc tube unit 12 is carried out with the rear edge faces of the slider metal parts 22 as a reference. Further, a base plate 24 is fixed to the front end portion of the insulating plug 14, and the slider metal parts 22 are fixedly coupled to the base plate 24 by laser welding. At this time, the base plate 24 is brought into facial contact with the slider metal parts 22, whereby the second aligning of the arc tube unit 12 can be carried out.

With the primary and secondary aligning, the center axis of the arc tube unit 12 (i.e., the center axis of the shroud tube 18) may become slightly eccentric or tilted with respect to the reference bulb axis Ax.

In the light source bulb 10 according to the embodiment of the invention, a shielding film 26 is formed on the outer peripheral face 18*a* of the shroud tube 18, whereby the light source bulb 10 functions as a low-beam light source bulb. The shielding film 26 includes a lateral pair of narrow striped portions 26A1 and 26A2 extending along the reference bulb axis Ax, and a wide striped portion 26B having a predetermined width and extending in the circumferential direction in such a way as to couple both of the narrow striped portions 26A1 and 26A2.

Both of the narrow striped portions 26A1 and 26A2 are such that the center angle between their upper end edges is set to 195°, whereby a low-beam light distribution pattern having horizontal and tilted cut-off lines can readily been formed. Moreover, the wide striped portion 26B shields harmful light (light causing the generation of upward scattering light in the low-beam light distribution pattern) emitted backward from the discharge light emitting portion.

The shielding film 26 is formed by applying a coating P onto the outer peripheral face 18*a* of the shroud tube 18. As the coating P, use can be made of a water-based coating containing a filler so prepared as to have a viscosity of 0.1–2 Pa·s.

Figure 2:
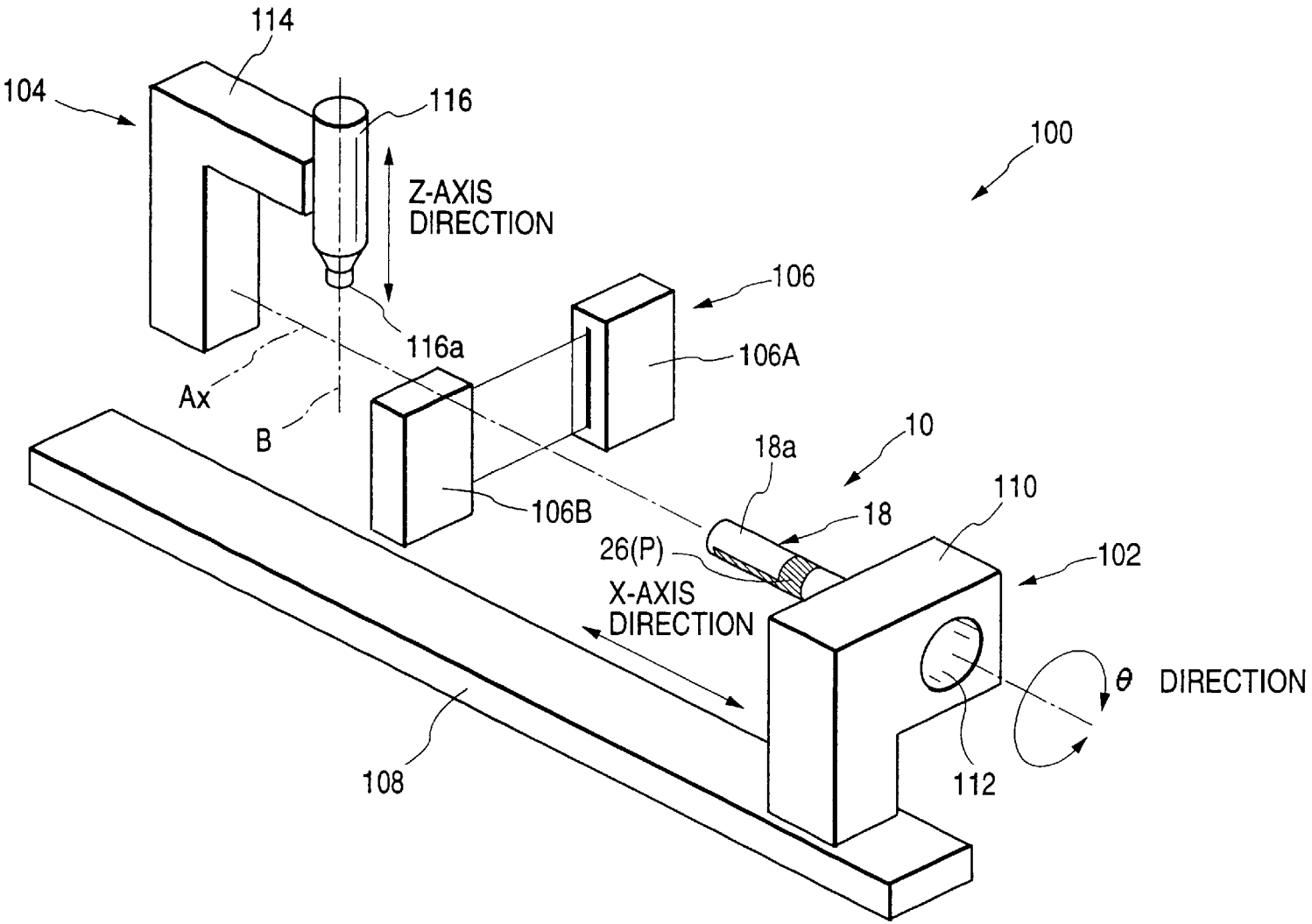
FIG. 2 is a schematic perspective view of a coating apparatus for applying a coating for providing the shielding film to the outer peripheral face of the shroud tube of the light source bulb.
Figure 3B:
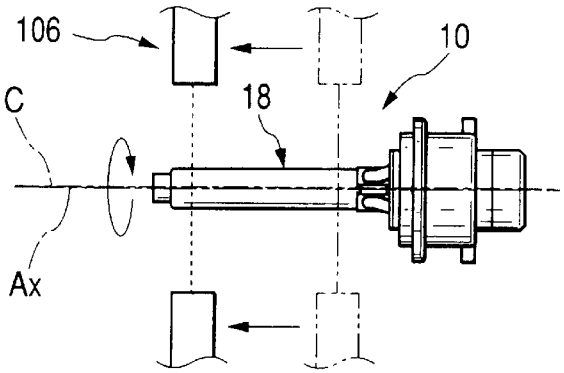
FIGS. 3A–3D are diagrams illustrating the process of applying the coating.
Figure 3D:
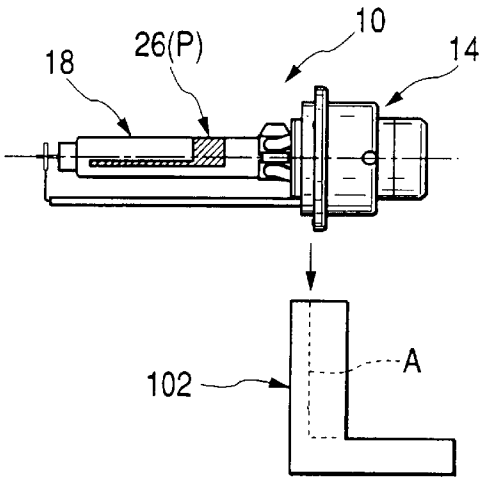
Figure 3A:
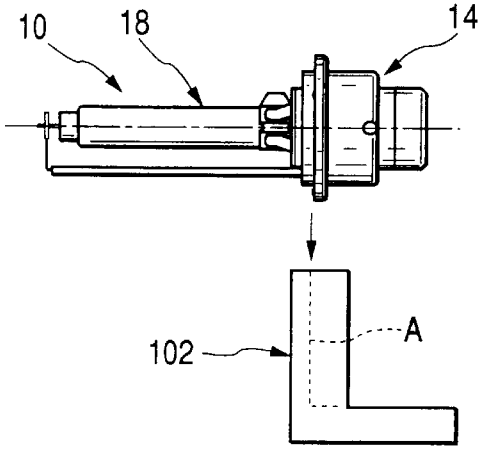

As shown in FIG. 2, the coating apparatus 100 comprises a bulb holding unit 102, a coating discharging unit 104, and a bulb posture measuring unit 106. The application of the coating P is carried out through the steps of fitting the light source bulb 10 to the bulb holding unit 102 as shown in FIG. 3A, measuring the posture of the light source bulb 10 using the bulb posture measuring unit 106 as shown in FIG. 3B, applying the coating P onto the outer peripheral face 18*a* of the shroud tube 18 using the coating discharging unit 104 as shown in FIG. 3C, and removing the light source bulb 10 thus completely coated therewith from the bulb holding unit 102 as shown in FIG. 3D.

As shown in FIG. 2, the bulb holding unit 102 includes a unit body 110 provided movably in the horizontal direction (X-axis direction) with respect to a base 108, and a bulb supporting ring 112 rotatably supported around the X-axis (in the direction of θ) with respect to the unit body 110. The bulb holding unit 102 is also fixedly supported in such a posture that the reference bulb axis Ax of the light source bulb 10 extends in the X-axis direction.

The coating discharging unit 104 includes a unit body 114 and a coating discharging portion 116 provided movably in the vertical direction (Z-axis direction) with respect to the unit body 114. The coating discharging portion 116 is vertically placed with the bottom up and its center axis B is set so as to cross the reference bulb axis Ax.

Figure 3C:
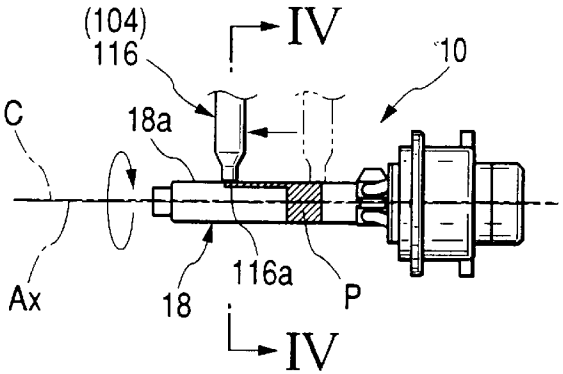
Figure 4:
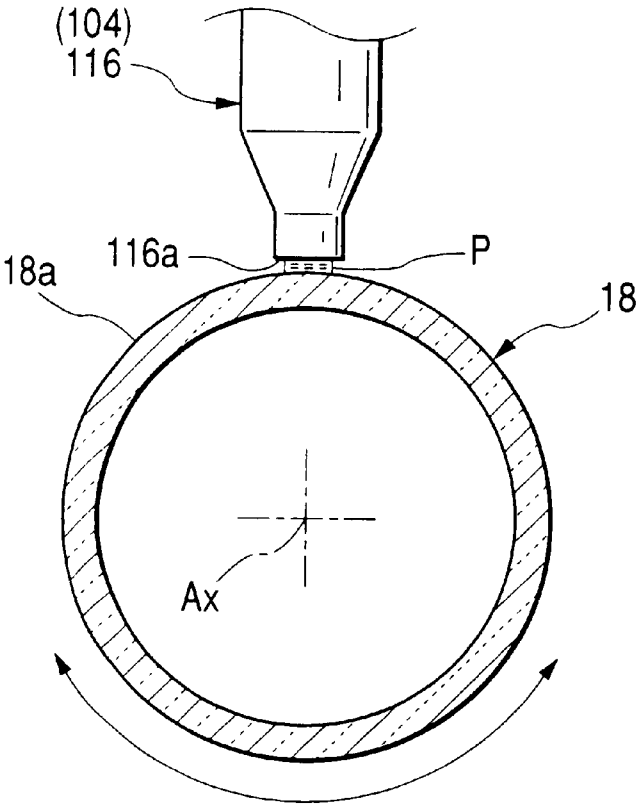
FIG. 4 is an enlarged sectional view taken on line IV—IV of FIG. 3C.
Figures 6A, 6B, 6C, 6D:
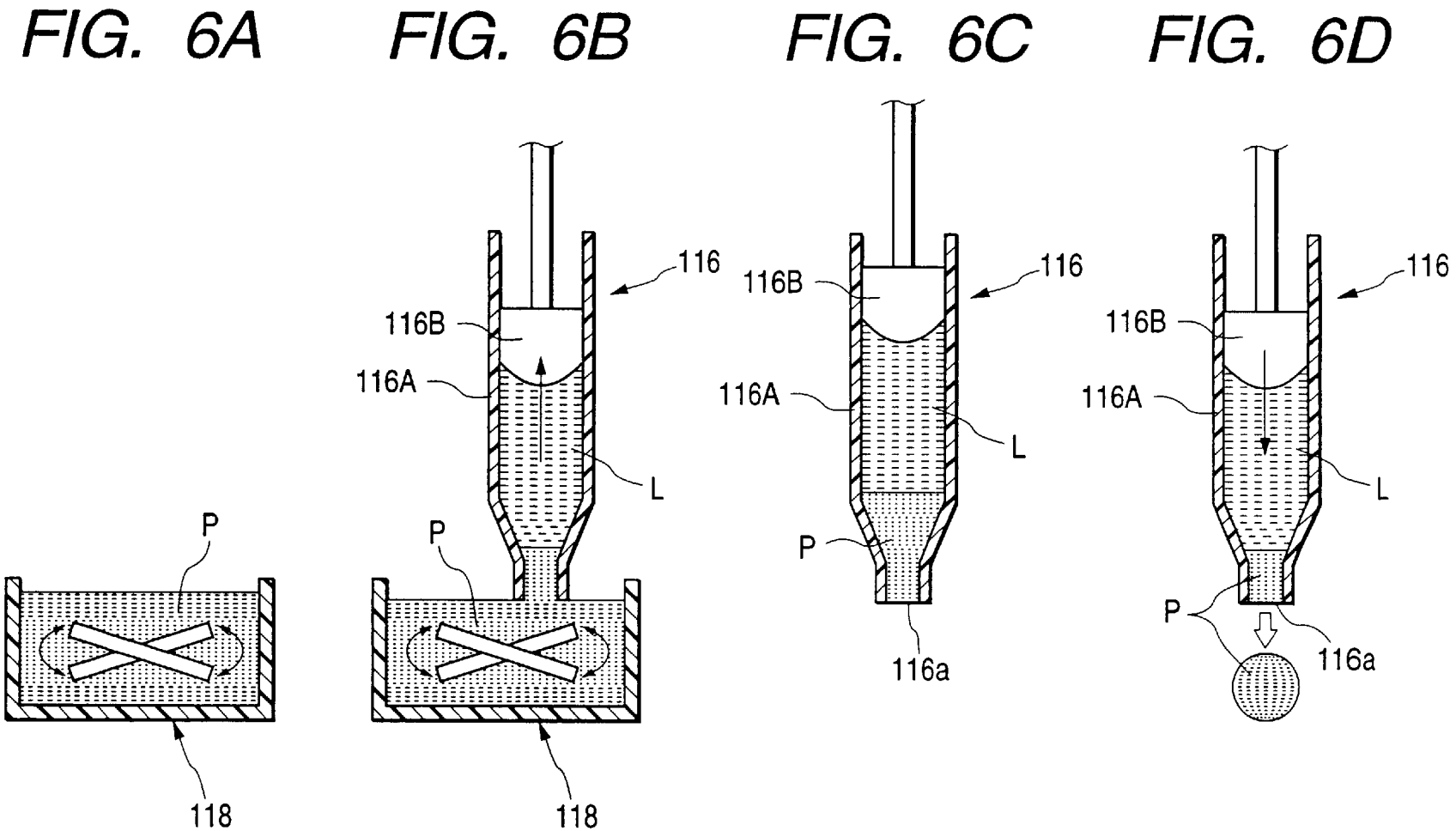
FIGS. 6 A–D are process drawings illustrating the coating being discharged from the coating discharging portion of the coating apparatus.
Figure 7B:
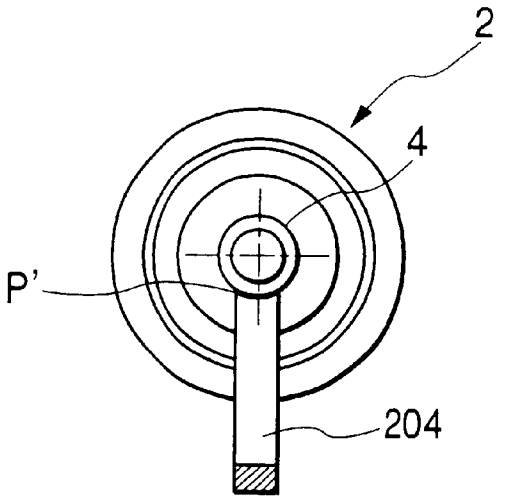
FIG. 7B PRIOR ART
FIGS. 7A and 7B are elevational views of an example of the prior art.
Figure 7A:
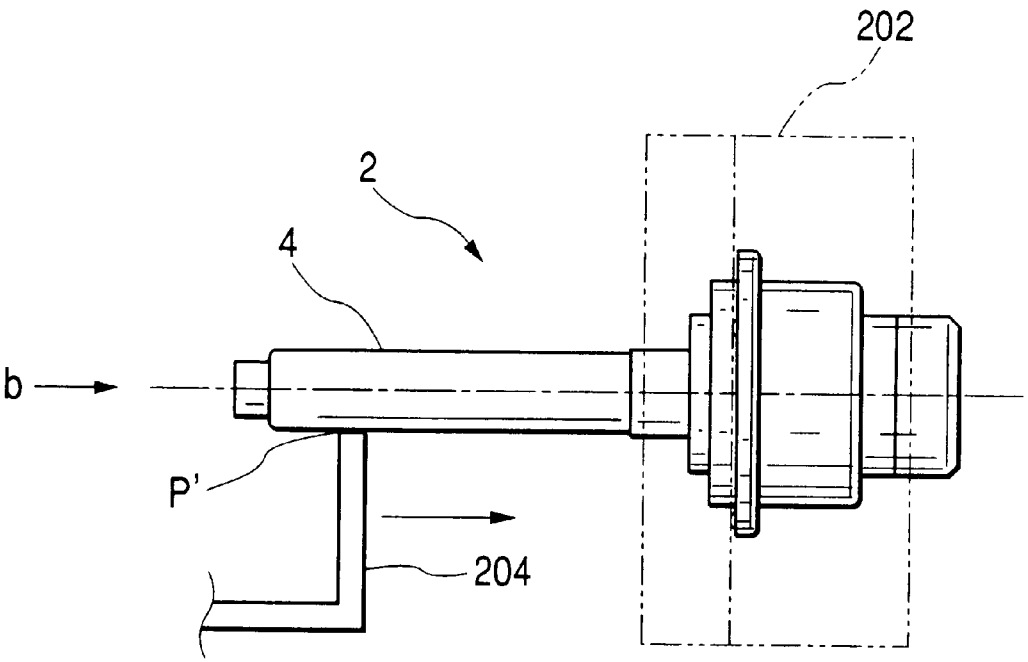
FIG. 7A PRIOR ART

Further, as shown in FIG. 3C and FIG. 4, which is an enlarged sectional view taken on line IV—IV of FIG. 3C, the front edge face 116*a* of the coating discharging portion 116 is moved close to the upper end portion of the outer peripheral face 18*a* of the shroud tube 18 of the light source bulb 10. As the coating P is being discharged from the coating discharging portion 116 in that condition, the light source bulb 10 is moved along the reference bulb axis Ax and also rotated upon the reference bulb axis Ax (in the direction of θ), so that the coating P is applied onto the outer peripheral face 18*a* of the shroud tube 18. The front end hole of the coating discharging portion 116 is set at 1 mm in diameter, whereby the coating P of about 1 mm in width can be formed.

Thus, the coating P can be held in a well-balanced condition between the front edge face 116*a* of the coating discharging portion 116 and the outer peripheral face 18*a* of the shroud tube 18 by horizontally orienting the light source bulb 10 and vertically orienting the coating discharging portion 116 with the bottom up, and discharging the coating P from the coating discharging portion 116 while the front edge face 116*a* of the coating discharging portion 116 is being moved close to the upper end portion of the outer peripheral face 18*a* of the shroud tube 18. Consequently, the coating P can be applied precisely onto the outer peripheral face 18*a* of the shroud tube 18 by moving the coating discharging portion 116 and the light source bulb 10 relatively to each other in that condition.

Further, the coating P is applied onto the outer peripheral face 18*a* of the shroud tube 18 to form the shielding film 26 with the operation of applying the coating once by moving and rotating the light source bulb 10 along and upon the reference bulb axis Ax.

Figure 5:
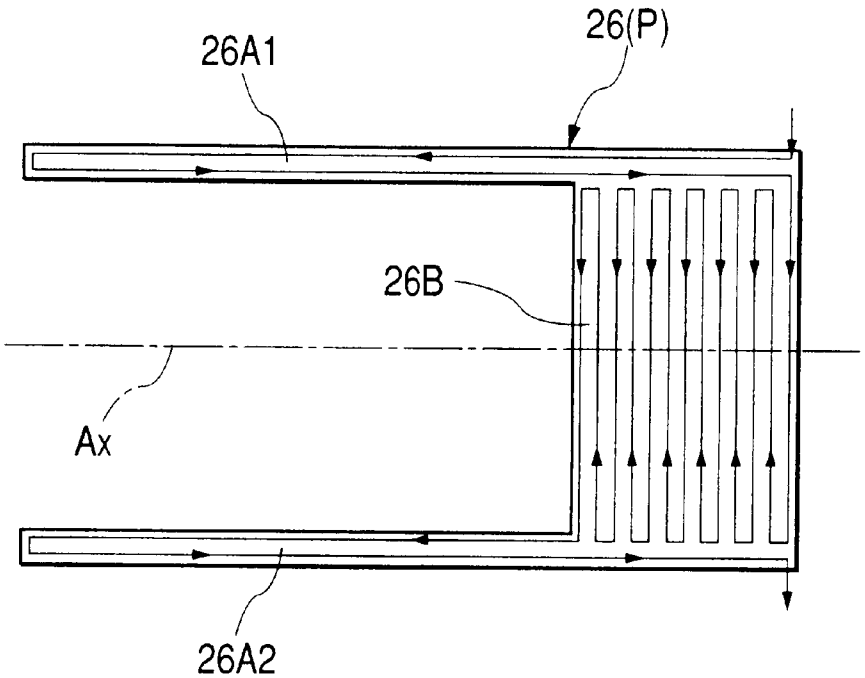
FIG. 5 is a plan view in the form of the expanded shielding film formed by the application of the coating.

The lengthwise and breadthwise bent line shown by arrows in FIG. 5 represents a relatively moving locus of the coating discharging portion 116 with respect to the light source bulb 10 when the coating P is applied (actually, the light source bulb 10 is moved). As shown in FIG. 5, the coating discharging portion 116 is reciprocated once along the reference bulb axis Ax to coat one narrow striped portion 26A1 with the coating P and then the coating discharging portion 116 is reciprocated a plurality of times along the reference bulb axis Ax to coat the wide striped portion 26B therewith. Finally, the coating discharging portion 116 is reciprocated once along the reference bulb axis Ax to coat the other narrow striped portion 26A2 with the coating P; to be precise, part of the rear end portion of the narrow striped portion 26A2 is coated when the wide striped portion 26B is coated therewith.

In order to apply the coating P precisely, the width of the coating P is required to be maintained as uniformly as possible and the gap between the front edge face 116*a* of the coating discharging portion 116 and the outer peripheral face 18*a* of the shroud tube 18 is also required to be kept substantially constant at all times. As shown in FIGS. 3B and 3C, however, the position of the upper end portion of the outer peripheral face 18*a* of the shroud tube 18 becomes slightly displaced in the vertical direction when the light source bulb 10 is rotated upon the reference bulb axis Ax since the center axis C of the actual shroud tube 18 is slightly eccentric or tilted with respect to the reference bulb axis Ax.

According to the embodiment of the invention, the gap between the front edge face 116*a* of the coating discharging portion 116 and the outer peripheral face 18*a* of the shroud tube 18 is kept substantially constant by slightly displacing the coating discharging portion 116 in the vertical direction with respect to the unit body 114.

In order to effect the slight displacement control accurately, importance is attached to securing accurate knowledge as to how the vertical position of a region opposite to the coating discharging portion on the outer peripheral face 18*a* of the shroud tube 18 varies as the coating discharging portion 116 and the light source bulb 10 move relatively to each other.

Therefore, according to the embodiment of the invention, the bulb posture measuring unit 106 is used to compute three-dimensional position data on an estimated position where the coating P is applied onto the outer peripheral face 18*a* of the shroud tube 18.

More specifically, the bulb posture measuring unit 106 is formed with a laser sensor including a laser emitting portion 106A and a laser receiving portion 106B, these being disposed with the reference bulb axis Ax held therebetween. Laser light having a predetermined width vertically and emitted from the laser emitting portion 106A is received by the laser receiving portion 106B so that the position of the shroud tube 18 can be detected. At this time, the position of the shroud tube 18 is detected at a plurality of circumferential spots (e.g., 10 spots) by rotating the shroud tube 18 upon the reference bulb axis Ax whereby to measure an eccentricity degree of the circular section of the shroud tube 18 with respect to the reference bulb axis Ax.

As shown in FIG. 3B, further, the eccentricity measurement is made at two spots along the reference bulb axis Ax to compute the three-dimensional position data on the estimated position where the coating P is applied onto the outer peripheral face 18*a* of the shroud tube 18 according to the measured data. Thus, it becomes possible to secure accurate knowledge as to how the vertical position of the region opposite to the coating discharging portion varies as the coating discharging portion 116 and the light source bulb 10 move relatively to each other.

As shown in FIGS. 6A–6D, the coating discharging portion 116 is in the form of a syringe including a syringe body 116A and a plunger 116B and so arranged as to discharge a predetermined amount of coating P after sucking into the syringe 116 a predetermined amount (slightly greater than the amount needed for application once) of coating P stirred in a vessel 118 other than the syringe 116. As a result, the coating discharging portion 116 is prevented from being clogged with the coating P composed of coating liquid containing a filler which quickly settles out.

Moreover, a predetermined amount of intermediate liquid L is prestored in the syringe body 116A and the coating P is sucked into the lower side of the intermediate liquid L. The intermediate liquid L is composed of fluid such as oil which is completely separated from the water-based coating P. Thus, the filler is prevented from being held in a slide portion between the syringe body 116A and the plunger 116B.

As set forth above in detail, the process of applying the coating P for providing the shielding film onto the outer peripheral face 18*a* of the shroud tube 18 according to the embodiment of the invention comprises the steps of: horizontally placing the light source bulb 10, vertically placing the coating discharging portion 116 with the bottom up and moving the front edge face 116*a* of the coating discharging portion close to the outer peripheral face 18*a* of the shroud tube 18; and applying the coating P thereto by moving the coating discharging portion 116 and the light source bulb 10 relative to each other along the reference bulb axis Ax and rotating the light source bulb 10 upon the reference bulb axis Ax while the coating P is being discharged from the coating discharging portion 116. Moreover, the process includes slightly displacing the coating discharging portion 116 when the coating is applied thereto so that the gap between the front edge face 116*a* of the coating discharging portion 116 and the outer peripheral face 18*a* of the shroud tube 18 may be kept substantially constant. Therefore, the following effect is achievable.

As the behavior of the light source bulb 10 at the time of coating application is represented by a combination of movement of the light source bulb 10 along the reference bulb axis Ax and the rotation thereof upon the reference bulb axis Ax, the light source bulb 10 is kept horizontal at all times. On the other hand, as the behavior of the coating discharging portion 116 at the time of coating application is equivalent to only the slight displacement thereof, the coating discharging portion 116 is kept vertical with the bottom up at all times. Accordingly, the coating P can be held between the front edge face 116*a* of the coating discharging portion 116 and the outer peripheral face 18*a* of the shroud tube 18 in a well-balanced condition after the front edge face 116*a* of the coating discharging portion 116 is moved close to the upper end portion of the outer peripheral face 18*a* of the shroud tube 18. Thus, the coating P can be applied precisely to the outer peripheral face 18*a* of the shroud tube 18 by moving the coating discharging portion 116 and the light source bulb 10 relatively to each other in that condition.

Despite the fact that the shielding film 26 is complicated in configuration, the shielding film 26 can be formed by applying the coating once by properly combining the movement and rotation of the light source bulb 10 along and upon the reference bulb axis Ax.

As the gap between the front edge face 116*a* of the coating discharging portion 116 and the outer peripheral face 18*a* of the shroud tube 18 is kept substantially constant by slightly displacing the coating discharging portion 116, the width of the coating P can also be kept substantially constant even though the shroud tube 18 is slightly eccentric or tilted with respect to the reference bulb axis Ax.

According to the embodiment of the invention, the shielding film 26 can be formed efficiently and precisely by applying the coating P having a substantially uniform width with the reference bulb axis Ax as a reference to the outer peripheral face 18*a* of the shroud tube 18 even though the shroud tube 18 is slightly eccentric or tilted with respect to the reference bulb axis Ax. As the shielding film 26 has a function of forming horizontal and tilted cut-off lines in the low-beam light distribution pattern in particular, it is extremely important that the shielding film 26 be formed precisely with the reference bulb axis Ax as a reference.

According to the embodiment of the invention, moreover, as the bulb posture measuring unit 106 is used to measure an eccentricity degree of the circular section of the shroud tube 18 with respect to the reference bulb axis Ax at two spots along the reference bulb axis Ax and to compute the three-dimensional position data on the estimated position where the coating P is applied onto the outer peripheral face 18*a* of the shroud tube 18 according to the measure data, it is possible to secure accurate knowledge as to how the vertical position of the region opposite to the coating discharging portion varies on the outer peripheral face 18*a* of the shroud tube 18 as the coating discharging portion 116 and the light source bulb 10 move relatively to each other. Thus, the slight displacement control can be effected accurately.

According to the embodiment of the invention, use of the coating P so prepared as to have a viscosity of 0.1–2 Pa·s prevents the coating P applied to the outer peripheral face 18*a* of the shroud tube 18 from sagging and also the coating application efficiency from being reduced because the coating dischargeability becomes poor.

According to the embodiment of the invention, further, the coating discharging portion is formed with a syringe so that the predetermined amount of coating stirred in a vessel other than the syringe may be sucked by and discharged from the syringe. Consequently, the coating discharging portion is prevented from being clogged with the coating without complicating the structure of the coating discharging portion and making any costly arrangement despite the fact that the coating P is composed of coating liquid containing the filler which quickly settles out.

Moreover, the predetermined amount of intermediate liquid L composed of the fluid which is completely separated from the coating P is contained in the syringe body 116A, and the coating P is sucked into the lower side of the intermediate liquid L. Therefore, the filler is prevented from being held in the slide portion between the syringe body 116A and the plunger 116B. As the discharge amount of coating P is thus prevented from varying because of the frictional wear caused to the slide portion, coating discharging precision is made improvable thereby.

In the embodiment of the invention, a description has been given of a case where the light source bulb 10 is a low-beam discharge bulb to be mounted in a vehicular headlamp and where the shielding film 26 is a striped (so-called black striped) shielding film having a function of forming horizontal and tilted cut-off lines in the low-beam light distribution pattern. Even in a case where a (so-called blacktop) shielding film to be formed in the front end portion of a halogen lamp or the like, working effect similar to what has been described in the embodiment of the invention is still achievable by adopting the producing method according to the embodiment thereof. When the shielding film is complicated in configuration particularly in the case of a blacktop having the rear end edge so configured as to correspond to a reflector opening, for example, it is especially effective to adopt the producing method according to the embodiment of the invention.

What is claimed is:

1. A method producing a light source bulb by applying a coating on an outer peripheral face of a cylindrical glass tube of said light source bulb so as to form a predetermined shielding film on said outer peripheral face, said cylindrical glass tube extending along a reference bulb axis, said method comprising the steps of:

horizontally supporting said light source bulb;

vertically placing a coating discharging portion having a discharge port facing downwardly;

moving the front edge face of said coating discharging portion such that a gap is disposed between said discharge port and said outer peripheral face; and applying said coating to the outer peripheral face of the glass tube by moving said coating discharging portion and said light source bulb relatively to each other along said reference bulb axis and rotating said light source bulb upon said reference bulb axis while said coating is being discharged from said coating discharging portion;

wherein said coating is applied to predetermined portions that have a surface area less than the entire surface area of the outer peripheral face of the glass tube, and wherein said predetermined portions comprise striped portions which extend along said reference bulb axis and have a circumferential width less than the entire circumferential width of the outer peripheral face of said glass tube;

said method further comprising the steps of:

measuring an eccentricity degree of a circular cross-section of said glass tube with respect to said reference bulb axis at two or more spots along said reference bulb axis, and computing three-dimensional position data where the coating is applied onto the outer peripheral face of said glass tube according to measured data obtained from said measuring.

2. The method as claimed in claim 1, further comprising the step of displacing one of said coating discharging portion and said light source bulb in the vertical direction when said coating is applied to said light source bulb so that said gap is substantially constant.

3. The method as claimed in claim 1, wherein said coating discharging portion comprises a syringe and wherein a predetermined amount of intermediate liquid is contained in said syringe before said coating is sucked by and discharged from said syringe;

wherein, said intermediate liquid and said coating do not mix.

4. The method as claimed in claim 1, wherein the eccentricity degree of a circular cross-section of said glass tube is measured by a laser sensor including a laser emitting portion and a laser receiving portion, and said laser emitting portion and said laser receiving portion are disposed with said reference bulb axis held therebetween.

5. The method as claimed in claim 1, wherein said coating is so prepared as to have a viscosity of 0.1–2 Pa·s (Pascal·sec).

6. The method as claimed in claim 1, wherein said coating discharging portion comprises a syringe and wherein a predetermined amount of coating stirred in a vessel other than said syringe is sucked by and discharged from said syringe.

7. A method producing a light source bulb by applying a coating on an outer peripheral face of a cylindrical glass tube of said light source bulb so as to form a predetermined shielding film on said outer peripheral face, said cylindrical glass tube extending along a reference bulb axis, said method comprising the steps of:

horizontally supporting said light source bulb;

vertically placing a coating discharging portion having a discharge port facing downwardly;

moving the front edge face of said coating discharging portion such that a gap is disposed between said discharge port and said outer peripheral face; and applying said coating to the outer peripheral face of the glass tube by moving said coating discharging portion and said light source bulb relatively to each other along said reference bulb axis and rotating said light source bulb upon said reference bulb axis while said coating is being discharged from said coating discharging portion, wherein said coating discharging portion comprises a syringe and wherein a predetermined amount of intermediate liquid is contained in said syringe before said coating is sucked by and discharged from said syringe, and further wherein said intermediate liquid and said coating do not mix.

8. A method producing a light source bulb by applying a coating on an outer peripheral face of a cylindrical glass tube of said light source bulb so as to form a predetermined shielding film on said outer peripheral face, said cylindrical glass tube extending along a reference bulb axis, said method comprising the steps of:

horizontally supporting said light source bulb;

vertically placing a coating discharging portion having a discharge port facing downwardly;

moving the front edge face of said coating discharging portion such that a gap is disposed between said discharge port and said outer peripheral face;

applying said coating to the outer peripheral face of the glass tube by moving said coating discharging portion and said light source bulb relatively to each other along said reference bulb axis and rotating said light source bulb upon said reference bulb axis while said coating is being discharged from said coating discharging portion;

measuring an eccentricity degree of a circular cross-section of said glass tube with respect to said reference bulb axis at two or more spots along said reference bulb axis; and computing three-dimensional position data where the coating is applied onto the outer peripheral face of said glass tube according to measured data obtained from said measuring, wherein the eccentricity degree of a circular cross-section of said glass tube is measured by a laser sensor including a laser emitting portion and a laser receiving portion, and said laser emitting portion and said laser receiving portion are disposed with said reference bulb axis held therebetween.

* * * * *